US008163449B2

(12) United States Patent
Yu et al.

(10) Patent No.: US 8,163,449 B2
(45) Date of Patent: Apr. 24, 2012

(54) ANTI-STATIC AND SLIPPERY ANTI-CURL BACK COATING

(75) Inventors: Robert C. U. Yu, Webster, NY (US); Edward F. Grabowski, Webster, NY (US); Yuhua Tong, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 1 day.

(21) Appl. No.: 12/851,193

(22) Filed: Aug. 5, 2010

(65) Prior Publication Data

US 2012/0034555 A1 Feb. 9, 2012

(51) Int. Cl.
*G03G 5/00* (2006.01)

(52) U.S. Cl. ..... 430/58.05; 430/56; 430/59.1; 430/930

(58) Field of Classification Search ..... 430/56, 430/58.05, 59.1, 69, 930; 399/159
See application file for complete search history.

(56) References Cited

U.S. PATENT DOCUMENTS 4,286,033 A * 8/1981 Neyhart et al.
4,291,110 A * 9/1981 Lee
4,338,387 A * 7/1982 Hewitt
4,464,450 A * 8/1984 Teuscher
4,587,189 A * 5/1986 Hor et al.
4,654,284 A * 3/1987 Yu et al.
4,664,995 A * 5/1987 Horgan et al.
4,921,773 A * 5/1990 Melnyk et al.
5,021,309 A * 6/1991 Yu
5,069,993 A * 12/1991 Robinette et al.
5,153,094 A * 10/1992 Kazmaier et al.
5,166,339 A * 11/1992 Duff et al.
5,189,155 A * 2/1993 Mayo et al.
5,189,156 A * 2/1993 Mayo et al.
5,382,486 A * 1/1995 Yu et al.
5,756,245 A * 5/1998 Esteghamatian et al.
5,919,590 A * 7/1999 Yu et al.
7,166,399 B2 1/2007 Carmichael et al.
7,455,941 B2 11/2008 Evans et al.
7,462,434 B2 * 12/2008 Yu et al.
2007/0059623 A1 * 3/2007 Yu ..... 430/69
2007/0292797 A1 * 12/2007 Yu et al. ..... 430/69

* cited by examiner

*Primary Examiner* — Mark F Huff
*Assistant Examiner* — Stewart Fraser
(74) *Attorney, Agent, or Firm* — Pillsbury Winthrop Shaw Pittman LLP

(57) ABSTRACT

The presently disclosed embodiments relate generally to the formulation of an anticurl back coating layer that renders imaging apparatus flexible members and components their desirable flatness, for use in electrostatographic, including digital apparatuses. More particularly, the embodiments pertain to an imaging member comprising an anticurl back coating layer formulated to comprise a polymer blend of an anti-static polymer and a low surface energy A-B diblock copolymer polymer and an adhesion promoter. The embodiments provide an imaging member belt with the anticurl back coating that is electrically conductive and also substantially reduces its surface contact friction to help suppress/eliminate tribo-electrical charge build-up at the backside of the imaging member belt under normal machine imaging member belt operational conditions in the field.

24 Claims, 1 Drawing Sheet

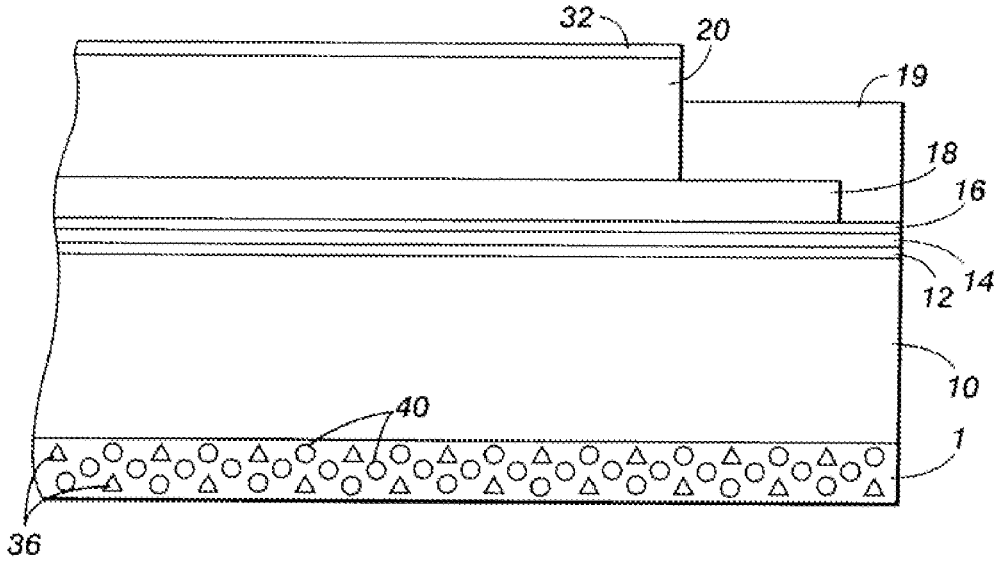
32
20
19
18
16
14
12
10
40
1
36

ANTI-STATIC AND SLIPPERY ANTI-CURL BACK COATING

BACKGROUND

The presently disclosed embodiments relate generally to the formulation of a layer that provides overall flatness to imaging apparatus flexible members and components for use in electrostatographic, including digital, apparatuses. More particularly, the embodiments pertain to an improved flexible electrophotographic imaging member belt prepared to include an anti-curl back coating comprising a specific polymer blend which includes an anti-static polymer and low surface energy polycarbonate that: (1) impacts surface energy lowering effect for contact friction reduction to ease imaging member belt drive and (2) imparts anti-static property to eliminate tribo-electrical charge build-up under normal imaging member belt operational conditions in the field.

Flexible electrostatographic imaging members are well known in the art. Typical flexible electrostatographic imaging members include, for example: (1) electrophotographic imaging member belts (photoreceptors) commonly utilized in electrophotographic (xerographic) processing systems; (2) electroreceptors such as ionographic imaging member belts for electrographic imaging systems; and (3) intermediate toner image transfer members such as an intermediate toner image transferring belt which is used to remove the toner images from a photoreceptor surface and then transfer the very images onto a receiving paper. The flexible electrostatographic imaging members may be seamless or seamed belts; a seamed belt is usually formed by cutting a rectangular imaging member sheet from a web stock, overlapping a pair of opposite ends, and welding the overlapped ends together to form a welded seam belt. Typical electrophotographic imaging member belts include a charge transport layer and a charge generating layer on one side of a supporting substrate layer and an anti-curl back coating coated onto the opposite side of the substrate layer. A typical electrographic imaging member belt does, however, have a more simple material structure; it includes a dielectric imaging layer on one side of a supporting substrate and an anti-curl back coating on the opposite side of the substrate. Although the scope of the present embodiments cover the preparation of all types of flexible electrostatographic imaging members, but for reason of simplicity, the discussion hereinafter will be focused on and represented only by flexible electrophotographic imaging members.

Flexible electrophotographic imaging members include a photoconductive layer having a single layer or composite layers. Because typical electrophotographic imaging members exhibit undesirable upward imaging member curling, an anti-curl back coating is required to offset the curl. Thus, the application of the anti-curl back coating is used to render the imaging member with appropriate flatness.

Electrophotographic imaging members, e.g., photoreceptors, photoconductors, and the like, include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment moves under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl back coating (ACBC) layer on the backside of the substrate, opposite to the side of the electrically active layers, to render the desired photoreceptor flatness.

In current organic belt photoreceptors, an anti-curl back coating layer is used to balance residual stresses caused by the top CTL coating of the photoreceptor and eliminate curling. In addition, the ACBC layer should have optically suitable transmittance, for example, transparent, so that the photoreceptor can be erased from the back. Existing formulations for anti-curl back coating layers are of low conductivity such that the anti-curl back coating layer takes on a tribo-electrical charge during use in the image-forming apparatus. This tribo-electrical charge increases drag in the image-forming apparatus and increases the load on the motor and wear of the anti-curl back coating layer. Additional components, such as active countercharge devices, or additives, such as conductive agents, have been used to attempt to eliminate the tribo-charging of the layer. However, these options are not desirable as they increase costs and complexity by including additional components or include additives which produce ACBC dispersions that do not have the suitably optical clarity to allow imaging member back erase. Thus, there is a need for an improved ACBC that does not suffer from the above-described problems.

Relevant prior arts to the present disclosure are collectively summarized for reference and presented in the following:

U.S. Pat. No. 5,919,590 discloses an electrostatographic imaging member comprising a supporting substrate having an electrically conductive layer, at least one imaging layer, an anti-curl layer, an optional ground strip layer and an optional overcoat layer, the anti-curl layer including a film-forming polycarbonate binder, an optional adhesion promoter, and optional dispersed particles selected from the group consisting of inorganic particles, organic particles, and mixtures thereof.

In U.S. Pat. No. 5,069,993, an exposed layer in an electrophotographic imaging member is provided with increase resistance to stress cracking and reduced coefficient of surface friction, without adverse effects on optical clarity and electrical performance. The layer contains a polymethylsiloxane copolymer and an inactive film-forming resin binder. Various specific film-forming resins for the anti-curl layer and adhesion promoters are disclosed.

U.S. Pat. No. 5,021,309 discloses an electrophotographic imaging device, with material for an exposed anti-curl layer has organic fillers dispersed therein. The fillers provide coefficient of surface contact friction reduction, increased wear resistance, and improved adhesion of the anti-curl layer, without adversely affecting the optical and mechanical properties of the imaging member.

In U.S. Pat. No. 4,654,284 an electrophotographic imaging member is disclosed comprising a flexible support substrate layer having an anti-curl layer, the anti-curl layer comprising a film-forming binder, crystalline particles dispersed in the film-forming binder and a reaction product of a bifunctional chemical coupling agent with both the binder and the crystalline particles. The use of VITEL PE 100 in the anti-curl layer is described.

The above prior art disclosures show that, while attempts to resolve ACBC layer failures described above have been successful with providing a solution, often times the success is negated due to the creation of another set of problems. Therefore, there is a need to provide improved imaging members that have mechanically robust outer layers to effect service life extension but without causing the introduction of other undesirable problems.

SUMMARY

According to embodiments illustrated herein, there is provided a flexible electrophotographic imaging member comprising: a flexible substrate; at least one imaging layer positioned on a first side of the substrate; and an anticurl back coating positioned on a second side of the substrate opposite to the at least one imaging layer, wherein the anticurl back coating comprises a polymer blend of an anti-static polymer and a low surface energy polycarbonate with the inclusion of a copolyester adhesion promoter, and the low surface energy polycarbonate is an A-B di-block copolymer comprising two segmental blocks, the first segment block (A) being

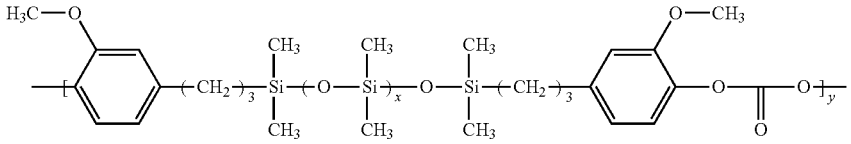

wherein x polydimethyl siloxane (PDMS) repeat units is from about 10 to about 70 and y is from about 1 to about 15, and the second segment block (B) being selected from the group consisting of

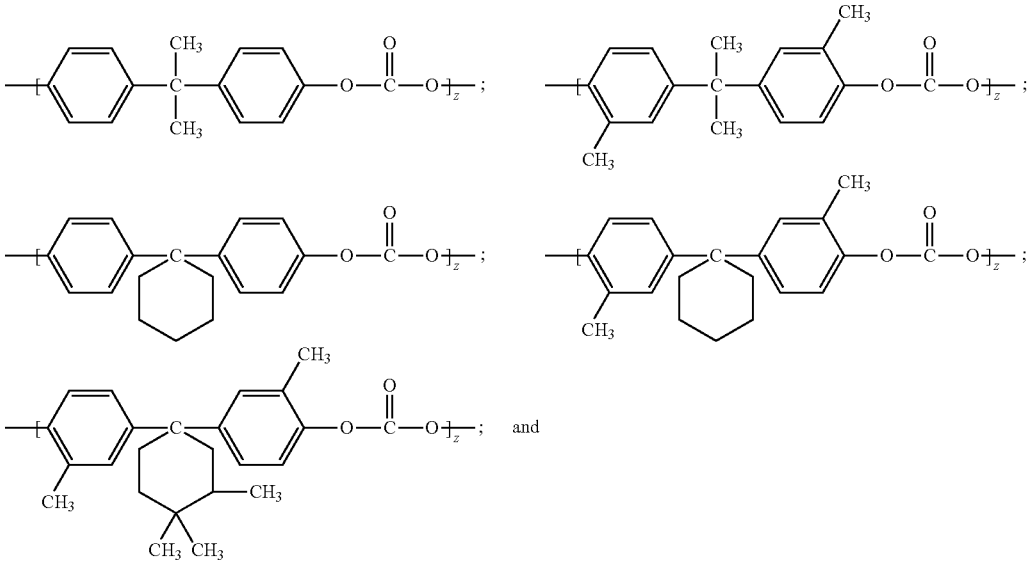

and

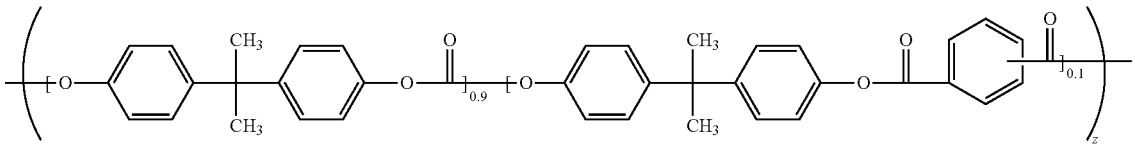

wherein z is from about 50 to about 400.

In other embodiments, there is provided a flexible imaging member comprising: a flexible substrate; a charge generating layer disposed on a first side of the substrate; a bottom charge transport layer disposed on the charge generating layer; an outermost top charge transport layer applied over the bottom charge transport layer; and an anticurl back coating positioned on a second side of the substrate opposite to the charge generating and charge transport layers, wherein the anticurl back coating comprises a polymer blend of an anti-static polymer and a low surface energy polycarbonate and a copolyester adhesion promoter, and the low surface energy polycarbonate is an A-B di-block copolymer comprising two segmental blocks, the first segment block (A) being

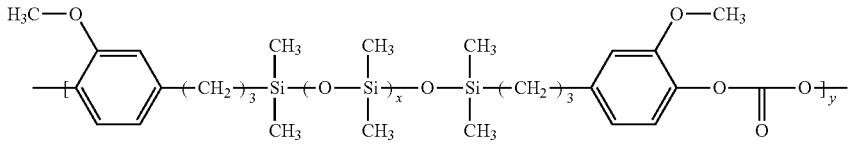

wherein x polydimethyl siloxane (PDMS) repeat units is from about 10 to about 70 and y is from about 1 to about 15, and the second segment block (B) being selected from the group consisting of

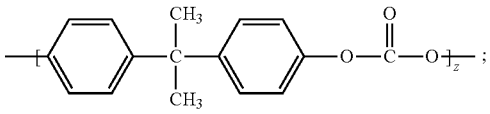

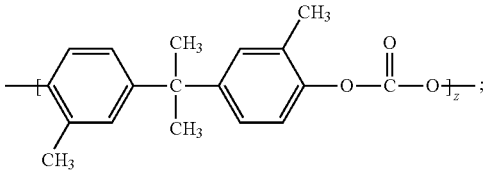

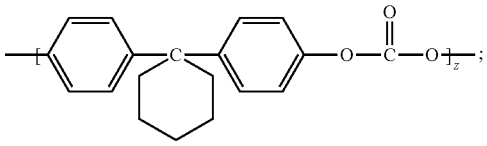

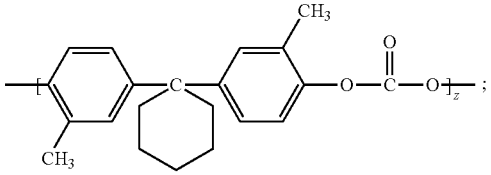

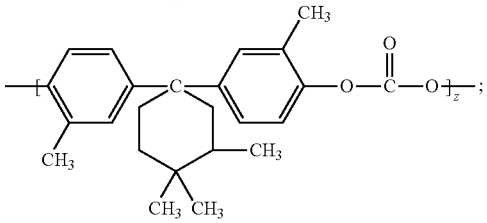

and

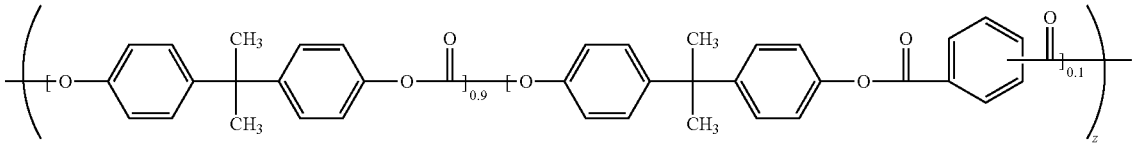

wherein z is from about 50 to about 400.

In further embodiments, there is provided an image forming apparatus for forming images on a recording medium comprising: a) a flexible imaging member having a charge retentive-surface for receiving an electrostatic latent image thereon, wherein the flexible imaging member comprises a flexible substrate, at least one imaging layer positioned on a first side of the substrate, and an anticurl back coating positioned on a second side of the substrate opposite to the at least one imaging layer, wherein the anticurl back coating comprising a polymer blend of an anti-static polymer and a low surface energy polycarbonate wherein the low surface energy polycarbonate is an A-B di-block copolymer comprising two segmental blocks, the first segment block (A) being

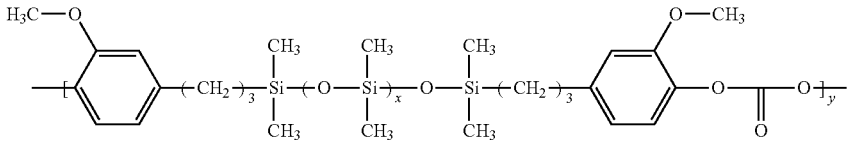

wherein x polydimethyl siloxane (PDMS) repeat units is from about 10 to about 70 and y is from about 1 to about 15, and the second segment block (B) being selected from the group consisting of

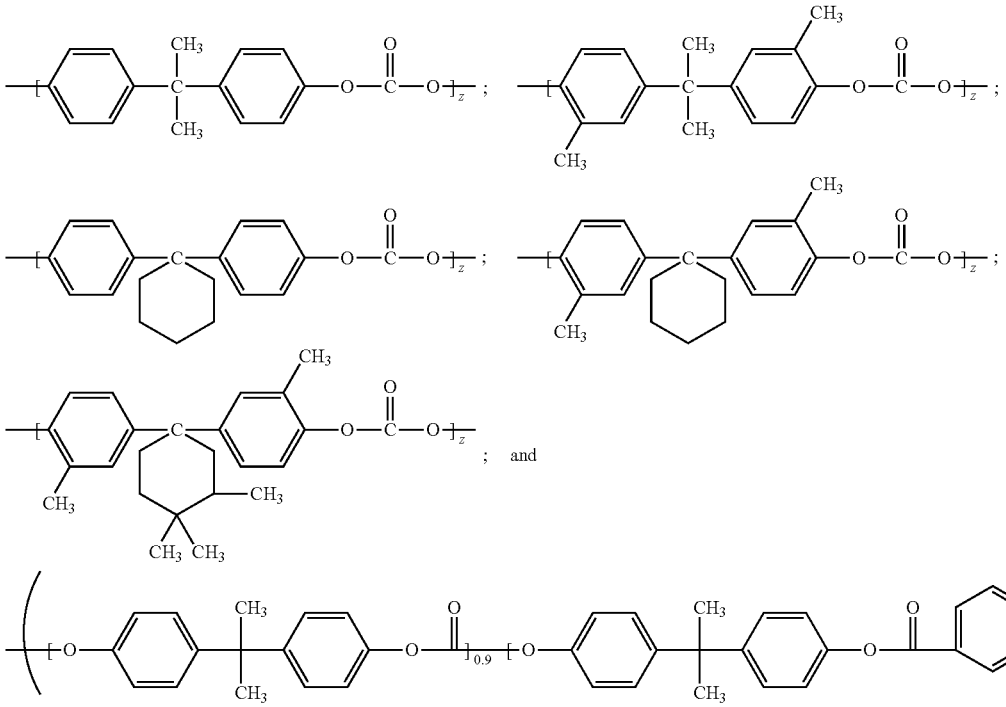

wherein z is from about 50 to about 400; b) a development component for applying a developer material to the charge-retentive surface to develop the electrostatic latent image to form a developed image on the charge-retentive surface; c) a transfer component for transferring the developed image from the charge-retentive surface to a copy substrate; and d) a fusing component for fusing the developed image to the copy substrate.

BRIEF DESCRIPTION OF THE DRAWINGS

For a better understanding, reference may be made to the accompanying FIGURE.

The FIGURE is a cross-sectional view of a multiple layered electrophotographic imaging member in a flexible belt configuration comprising an anti-curl back coating layer (ACBC) formulation prepared according to the present embodiments.

DETAILED DESCRIPTION

In the following description, reference is made to the accompanying drawing, which form a part hereof and which illustrate embodiments of the present disclosure. It is understood that other embodiments may be utilized and structural and operational changes may be made without departure from the scope of the present disclosure.

A conventional, negatively charged, flexible multiple layered electrophotographic imaging member, having a top outermost exposed CTL and a bottom exposed ACBC layer, is illustrated in the FIGURE. The substrate 10 has an optional conductive layer 12. An optional hole blocking layer 14 can be applied over the conductive layer 12, and then followed up with an optional adhesive layer 16. The charge generating layer (CGL) 18 is located above the layers 16, 14, 12, and 10 but below the top outermost CTL 20. An optional ground strip layer 19, operatively connects the CGL 18 and the CTL 20 to the conductive layer 12, is included to effect electrical continuity. An ACBC layer 1 is usually the last layer to be applied onto the side of substrate 10, opposite from the electrically active layers, to render the imaging member flat.

Since the CTL is the top outermost layer coated over the CGL and is applied by solution coating, then subsequently followed by drying the wet applied CTL coating at elevated temperatures of about 120° C., and finally cooling down the coated photoreceptor to the ambient room temperature of about 25° C. Therefore, when a production imaging member web stock of several thousand feet of coated multilayered photoreceptor material is obtained after finishing solution application of the CTL coating and through drying/cooling process will, if unrestrained, spontaneous curl upwardly into a roll. This upward curling is a consequence of thermal contraction mismatch between the CTL and the substrate support. Since the CTL in a typical photoreceptor device has a coefficient of thermal contraction approximately 3.7 times greater than that of the flexible substrate support, the CTL does therefore have a larger dimensional shrinkage than that of the flexible substrate support after the eventual photoreceptor web stock cools down to the ambient room temperature. The exhibition of photoreceptor web stock curling up after completion of CTL coating is due to the consequence of the heating/cooling cycles and processing step. Development of the upward curling can be explained by these mechanism: (1) as the web stock carrying the wet applied charge transport layer is dried at elevated temperature, dimensional contraction does occur when the wet CTL coating is losing its solvent during 120° C. elevated temperature drying, but at 120° C. the CTL remains as a viscous flowing liquid after losing its solvent. Since its glass transition temperature (Tg) is at 85° C., the CTL after losing of solvent will flow to re-adjust itself, release internal stress, and maintain its dimension stability; (2) as the CTL now in the viscous liquid state is cooling down further and reaching its glass transition temperature (Tg) at 85° C., the CTL instantaneously solidifies and adheres to the CGL below because it has then transformed itself from being a viscous liquid into a solid layer at its Tg; and (3) eventual cooling down the solid CTL of the photoreceptor web, from 85° C. down to the 25° C. room ambient, will then cause the CTL to contract more than the flexible substrate support since it has about 3.7 times greater thermal coefficient of dimensional contraction than that of the substrate support. This differential in dimensional contraction results in tension strain built-up in the CTL which therefore, at this instant, pulls the photoreceptor web upwardly to exhibit curling. If unrestrained at this point, the photoreceptor web stock (say having 29-micrometer CTL thickness and 3½ mil polyethylene naphthalate substrate) will spontaneously curl-up into a 1½-inch roll. To offset the curling, an ACBC is applied to the backside of the flexible substrate support, opposite to the side having the CTL, and render the photoreceptor web stock with desired flatness.

The applied ACBC for curl control needs to have optically suitable transmittance, for example, transparency, so that the residual voltage presence on the photoreceptor can be erased by radiation illumination from the back side of the belt during electrophotographic imaging processes. Existing formulations for ACBC layers are formulated from non conductivity polymer such that the ACBC layer takes on a tribo-electrical charge build-up arisen from its frictional interaction against belt support module components during use in the image-forming apparatus which increases drag in the image-forming apparatus and increases the load on the motor and wear of the ACBC layer. And at time, the tribo-electrical charge does build-up to such a degree that the photoreceptor belt cycling motion is stalled under a normal machine belt functioning condition. Additional machine components, such as active countercharge devices, have been used to eliminate or suppress the tribo-charging of the layer. However, the use of additional components adds to the costs and does also introduce complexity of the photoreceptor function so it is not desirable.

Alternatively, ACBC reformulation had also been created to include conductive agents such as carbon black dispersion in the ACBC layer to bleed off any tribo charges. Unfortunately, these dispersions are not very stable, lead to coating solution carbon black particles flocculation problems, and require milling the dispersion excessively, which in turn lowers the conductivity. Moreover, another problem arises too when using carbon black dispersion in the ACBC layer, it is required to use high particle dispersion levels to achieve the conductivity needed for effective tribo-charging elimination. Nonetheless, high loading level addition not only has resulted in a layer that is almost always opaque not optically suitable for effective photoreceptor belt back erase, it has often been found to cause the creation of other adverse side effects as well. Therefore, there is a need to create a new and novel ACBC formulation which does not have these shortfalls.

In the present disclosure, embodiments are directed generally to an improved flexible electrostatographic imaging member, particularly the flexible multiple layered electrophotographic imaging member or photoreceptor, in which the ACBC of this disclosure is formed by polymer blending of two different film-forming thermoplastic materials—one imparting anti-static property and the other imparting a surface energy lowering effect for surface contact reduction. The resulting ACBC as prepared according to the present embodiments and methodology of present disclosure has good optical clarity as well as anti-curling control to impact imaging member flatness. In these embodiments, one of the thermoplastic material comprises an anti-static copolymer consisting of polyester, polycarbonate, and polyethylene glycol units. The second thermoplastic material is an A-B diblock copolymer consisting of a segmental bisphenol polycarbonate block (B) in linear linkage to a segmental polydimethyl siloxane block (A) to render ACBC surface energy lowering and slipperiness.

In electrostatographic reproducing or digital printing apparatuses using a flexible photoreceptor belt, a light image is recorded in the form of an electrostatic latent image upon a photosensitive member and the latent image is subsequently rendered visible by the application of a developer mixture. The developer, having toner particles contained therein, is brought into contact with the electrostatic latent image to develop the image on the photoreceptor belt which has a charge-retentive surface. The developed toner image can then be transferred to a copy out-put substrate, such as paper, that receives the image via a transfer member.

The exemplary embodiments of this disclosure are further described below with reference to the drawing. The specific terms are used in the following description for clarity, selected for illustration in the drawings and not to define or limit the scope of the disclosure. The structures in the FIGURE are not drawn according to their relative proportions and the drawings should not be interpreted as limiting the disclosure in size, relative size, or location. In addition, though the discussion will address negatively charged systems, the imaging members of the present disclosure may also included material compositions designed to be used in positively charged systems. Also the term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

Referring back to the FIGURE, an embodiment of a negatively charged flexible multiple layered electrophotographic imaging member having a belt configuration is shown. As can be seen, the belt configuration is provided with an anti-curl back coating (ACBC) 1, a supporting substrate 10, an electrically conductive ground plane 12, an undercoat layer 14, an adhesive layer 16, a charge generation layer (CGL) 18, and a charge transport layer (CTL) 20. An optional overcoat layer 32 and ground strip 19 may also be included. An exemplary photoreceptor having a belt configuration is disclosed in U.S.

Pat. No. 5,069,993, which is hereby incorporated by reference. U.S. Pat. Nos. 7,462,434; 7,455,941; 7,166,399; and 5,382,486 further disclose exemplary photoreceptors and photoreceptor layers such as a conductive AXCBC layer. Although the formation of the CGL 18 and the CTL 20 of the negatively charged imaging member described and shown in the FIGURE here has two separate layers, nonetheless it may also be appreciated that the functional components of these layers be alternatively combined and formulated into a single layer. However, the CGL 18 may also be disposed on top of the CTL 20, so the imaging member is therefore converted into a positively charge member.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, as shown in the FIGURE, the belt can be seamed or seamless. In other embodiments, the photoreceptor herein is rigid and is in a drum configuration.

The thickness of the substrate 10 of a flexible belt depends on numerous factors, including flexibility, mechanical performance, and economic considerations. The thickness of the flexible support substrate 10 of the present embodiments may be from about 1.0 to about 7.0 mils, or from about 2.0 to about 5.0 mils for optimum mechanical function.

An exemplary flexible substrate support 10 is not soluble in any of the solvents used in each coating layer solution, is optically transparent or semi-transparent, and is thermally stable up to a high temperature of about 150° C. A substrate support 10 used for imaging member fabrication may have a thermal contraction coefficient ranging from about $1\times10^{-5}$ per ° C. to about $3\times10^{-5}$ per ° C. and a Young's Modulus of from about $5\times10^{-5}$ psi ($3.5\times10^{-4}$ Kg/cm$^2$) to about $7\times10^{-5}$ psi ($4.9\times10^{-4}$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength of from about 4000 Angstroms to about 9000 Angstroms or a conductive carbon black dispersed in a polymeric binder as an opaque conductive layer.

The Hole Blocking Layer

After deposition of the electrically conductive ground plane layer 12, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl)methyl diethoxysilane, and $[H_2N(CH_2)_3]CH_3Si(OCH_3)_2$ (gamma-aminopropyl)methyl diethoxysilane, as disclosed in U.S. Pat. Nos. 4,338,387, 4,286,033 and 4,291,110.

The hole blocking layer should be continuous and have a thickness of less than about 0.5 micrometer because greater thicknesses may lead to undesirably high residual voltage. A hole blocking layer of from about 0.005 micrometer to about 0.3 micrometer is used because charge neutralization after the exposure step is facilitated and optimum electrical performance is achieved. A thickness of from about 0.03 micrometer to about 0.06 micrometer is used for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of from about 0.05:100 to about 0.5:100 is satisfactory for spray coating.

In optional embodiments of the hole blocking may alternatively be prepared as an undercoat layer which may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The Adhesive Layer

An optional separate adhesive interface layer 16 may be provided in certain configurations, such as for example, in flexible web configurations. In the embodiment illustrated in the FIGURE, the interface layer 16 would be situated between the blocking layer 14 and the CGL 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorbenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer may have a thickness of at least about 0.01 micrometers, or no more than about 900 micrometers after drying. In embodiments, the dried thickness is from about 0.03 micrometers to about 1 micrometer.

The Ground Strip Layer

The ground strip layer 19 may comprise a film-forming polymer binder and electrically conductive particles. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness of at least about 7 micrometers, or no more than about 42 micrometers, or of at least about 14 micrometers, or no more than about 27 micrometers.

The Charge Generation Layer

The CGL 18 may thereafter be applied to the undercoat layer 14. Any suitable charge generation binder including a charge generating/photoconductive material, which may be in the form of particles and dispersed in a film-forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film-forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength of from about 400 to about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

A number of titanyl phthalocyanines, or oxytitanium phthalocyanines for the photoconductors illustrated herein are photogenerating pigments known to absorb near infrared light around 800 nanometers, and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the disclosures of which are totally incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the disclosure of which is totally incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

Any suitable inactive resin materials may be employed as a binder in the CGL 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly(4,4'-dihydroxydiphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the CGL 18 may have a thickness of at least about 0.1 μm, or no more than about 2 μm, or of at least about 0.2 μm, or no more than about 1 μm. These embodiments may be comprised of chlorogallium phthalocyanine or hydroxygallium phthalocyanine or mixtures thereof. The CGL 18 containing the charge generating material and the resinous binder material generally ranges in thickness of at least about 0.1 μm, or no more than about 5 μm, for example, from about 0.2 μm to about 3 μm when dry. The CGL thickness is therefore generally related to binder content. Higher binder content compositions generally employ thicker layers for charge generation.

The Charge Transport Layer

Although the CTL will be discussed specifically in terms of a single layer 20, but the details will be also applicable to an embodiment having dual charge transport layers. The CTL 20 is thereafter applied over the CGL 18 and may include any suitable transparent organic polymer or non-polymeric material capable of supporting the injection of photogenerated holes or electrons from the CGL 18 and capable of allowing the transport of these holes/electrons through the charge transport layer to selectively discharge the surface charge on the imaging member surface. In one embodiment, the CTL 20 not only serves to transport holes, but also protects the charge generation layer 18 from abrasion or chemical attack and may therefore extend the service life of the imaging member. The CTL 20 can be a substantially non-photoconductive material, but one which supports the injection of photogenerated holes from the CGL 18.

The CTL 20 is normally transparent in a wavelength region in which the electrophotographic imaging member is to be used when exposure is affected there to ensure that most of the incident radiation is utilized by the underlying charge generation layer 18. The CTL should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the CGL 18 is sandwiched between the substrate and the CTL 20. The CTL 20 in conjunction with the CGL 18 is an insulator to the extent that an electrostatic charge placed on the CTL is not conducted in the absence of illumination. The CTL 20 should trap minimal charges as the charge passes through it during the discharging process.

The CTL 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film-forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the CTL 20 in order to discharge the surface charge on the CTL. The high mobility charge transport component may comprise small molecules of an organic compound which cooperate to transport charge between molecules and ultimately to the surface of the CTL 20. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the CTL, which layer generally is of a thickness of from about 5 to about 75 micrometers, and more specifically, of a thickness of from about 15 to about 40 micrometers. Examples of charge transport components are aryl amines of the following formulas/structures:

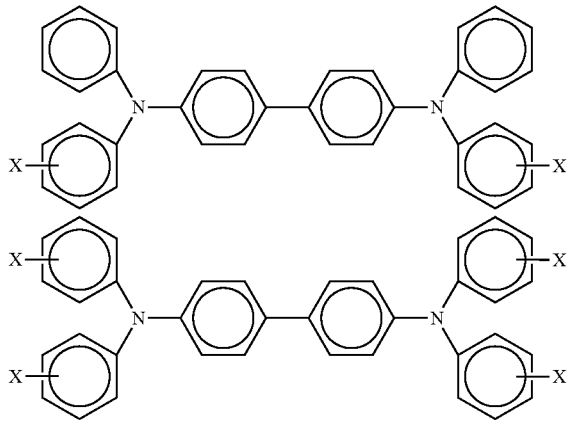

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

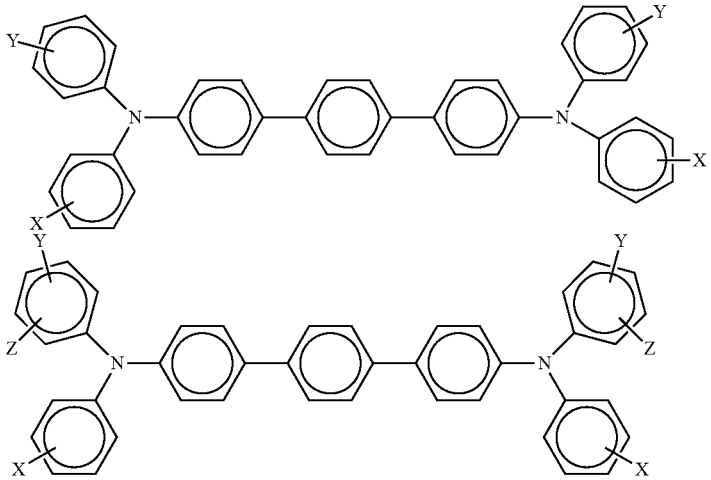

and wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARKT™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The CTL should be an insulator to the extent that the electrostatic charge placed on the CTL surface is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

Any suitable and conventional technique may be utilized to form and thereafter apply the CTL mixture to the supporting substrate layer. The CTL may be formed in a single coating step or in multiple coating steps to give dual layered and multiple layered CTLs. Dip coating, ring coating, spray, gravure or any other drum coating methods may be used. For the dual layered design, the CTL is comprised of an outermost top CTL and a bottom CTL in contiguous contact with the CGL. In embodiments, the top CTL contains less charge transport compound than the bottom CTL for mechanical robust function. Although the top and bottom CTL may have different thickness, it is preferred that they have the same thickness.

Drying of the deposited coating may be effected by any suitable conventional technique such as oven drying, infra red radiation drying, air drying and the like. The thickness of the CTL (being a single, dual, or multiple layered CTL) after drying is from about 10 μm to about 40 μm or from about 12 μm to about 36 μm for optimum photoelectrical and mechanical results. In another embodiment the thickness is from about 14 μm to about 36 μm.

Since the CTL 20 is applied by solution coating process, the applied wet film is dried at elevated temperature and then subsequently cooled down to room ambient. The resulting photoreceptor web if, at this point, not restrained, will spontaneously curl upwardly into a roll due to greater dimensional contraction and shrinkage of the CTL 20 than that of the substrate support layer 10.

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. Therefore, typical overcoat layer is formed from a hard and wear resistance polymeric material. In embodiments, the overcoat layer 32 may have a thickness ranging from about 0.1 micrometer to about 10 micrometers or from about 1 micrometer to about 10 micrometers, or in a specific embodiment, about 3 micrometers. These overcoating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including aluminum oxide, non-metal oxides including silica or low surface energy polytetrafluoroethylene (PTFE), and combinations thereof. Suitable resins include those described above as suitable for photogenerating layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoating layers may be continuous and have a thickness of at least about 0.5 micrometer, or no more than 10 micrometers, and in further embodiments have a thickness of at least about 2 micrometers, or no more than 6 micrometers.

The Anti-Curl Back Coating Layer

Since the photoreceptor web exhibits spontaneous upward curling after completion of charge transport layer coating process, an ACBC 1 is required to be applied to the back side of the substrate to counteract the curl and render flatness. The ACBC 1 may comprise organic polymers or inorganic polymers that are electrically insulating or slightly semi-conductive. The ACBC provides flatness and/or abrasion resistance. A typical ACBC 1 may be formed at the back side of the flexible substrate 10, opposite to the imaging layers. The ACBC may conventionally comprise a film-forming resin binder and an adhesion promoter additive. The resin binder may be the same resins as the resin binders of the CTL discussed above. Examples of film-forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 resin (Rohm and Haas), Vitel PE-100, Vitel PE-200, Vitel PE-307 (Goodyear), and the like. Usually from about 1 to about 15 weight percent adhesion promoter, based on the total weight of the ACBC is selected for addition.

The thermal coefficient of the ACBC is important and should match that of the photo-active layers, in order to achieve the flatness of the photoreceptor devices. In the present embodiments, the ACBC prepared according to the formulation of this disclosure is a polymer blend 40, comprising of an anti-static polymer blended with a low surface energy polycarbonate and additionally, a copolyester adhesion promoter 36, does also have at least 80% optical transparency in the wavelength of erasing radiation light using in the machine. Therefore, the ACBC of the present embodiments has the desirable static-electrical dissipation capability that is preferred, high wear resistance in order to have a long application life, and reasonable optical clarity; it does furthermore possess surface lubricity to impart surface contact friction reduction to minimize sliding friction induced triboelectrical build-up during dynamic machine imaging member belt cycling.

The disclosed ACBC layer 1 provides resolution to all of the issues discussed as being associated with conventional ACBC. As discussed, the innovative polymer blended ACBC material matrix includes (1) a film-forming thermoplastic anti-static copolymer comprising polyester, polycarbonate, and polyethylene glycol units in the molecular chain of the copolymer having polyester/polycarbonate/polyethylene glycol ratio of about 62/33/6, and (2) a novel film-forming low surface energy polymer component that is selected to provide both surface lubricity for surface contact friction reduction (e.g., achieves abrasion/wear/scratch resistance enhancement) and good optical clarity.

Anti-static copolymer STAT-LOY 63000 CTC is a commercially pre-compounded resin available from Sabic Innovative Plastics. It is a film forming thermoplastic material consisting of polyester, polycarbonate, and polyethylene glycol units in the molecular chain. STAT-LOY. Nuclear magnetic resonance (NMR) analysis of this compounded polymer showed that it is a mixture of about 62 parts of polyester (formed by trans-1,4-cyclohexanedicarboxylic acid and trans/cis mixture of 1,4-cyclohexanedimethanol), 33 parts of Bisphenol A polycarbonate (PCA), and at least 6 parts of polyethylene glycol (PEG).

The novel film-forming low surface energy polymer selected for the present disclosure ACBC application is a low surface energy polycarbonate. It is basically a bisphenol A polycarbonate that is derived or modified from bisphenol A polycarbonate to include polydimethyl siloxane (PDMS) segments in the main polycarbonate chain backbone. Therefore, the low surface energy polymer can be defined as an A-B diblock copolymer having two segmental blocks: that is a PDMS containing block (A) and a bisphenol A block (B) polycarbonate backbone shown below:

Block (A)

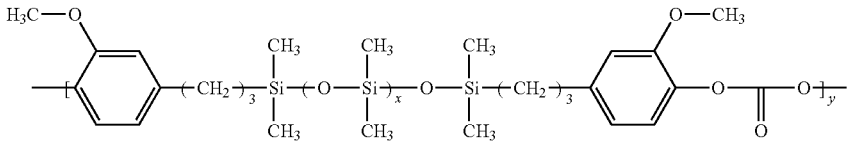

Block (B)

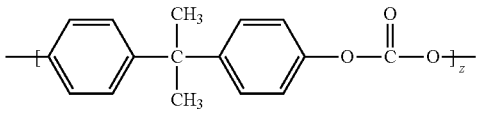

wherein x is the number of dimethyl siloxane (DMS) repeat units, ranging from about 10 to about 70; y is number of PDMS containing block (A) segment repeats of from about 1 to about 15 calculated based on from about 2 to about 10 weight percent of the molecular weight of the low surface energy polycarbonate; and z is the numbers of repeating bisphenol A polycarbonate of poly(4,4'-isopropylidene diphenyl carbonate) chain in block (B) determined from the molecular weight of from about 15,000 to about 130,000 of the low surface energy polycarbonate to give values of from 50 to 400. The A-B diblock copolymer structure of the low surface energy bisphenol A polycarbonate can therefore be generally represented by Formula (I) below:

Formula (I)

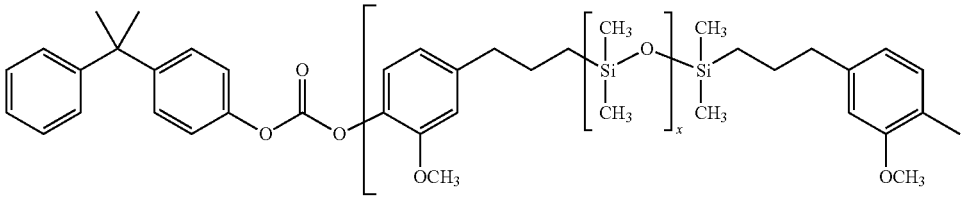

Block (A)

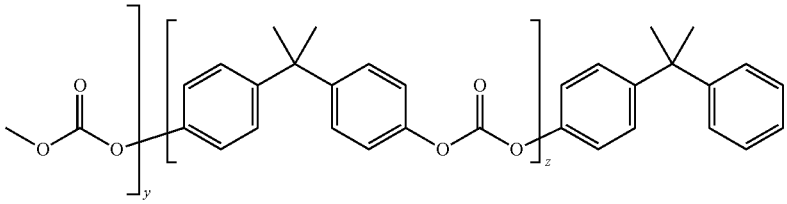

Block (B)

The low surface energy polycarbonate used for ACBC formulation should have a molecular weight of at least 15,000 but is preferably to be from about 20,000 to about 130,000 from solubility and viscosity consideration.

In the further embodiments, the novel low surface energy polycarbonate for use in formulating the anticurl back coating layer of this disclosure can alternatively be one of the several variances that are conveniently derived/obtained through the modification of block (B) segment of the polycarbonate main chain of Formula (I) to give further structures, as shown below:

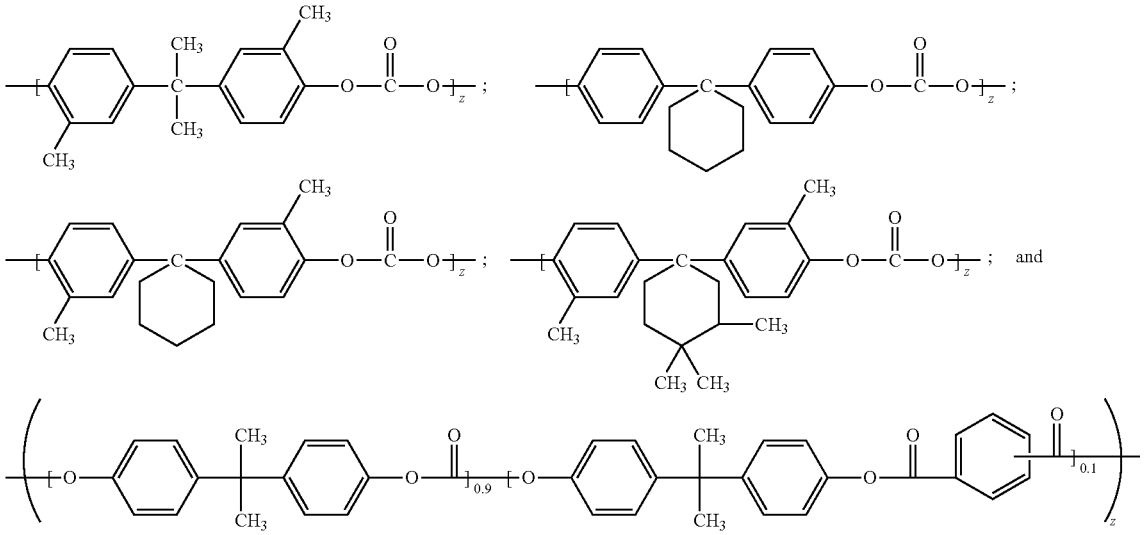

In essence, all the low surface energy polycarbonates described above contain dimethyl siloxane (DMS), having x repeating units of from about 10 to about 70, y is from about 1 to about 15, and z is from about 50 to about 400.

In specific embodiments, the above-described low surface energy polycarbonates contain dimethyl siloxane (DMS), having x repeating units of from about 10 to about 70, y is from about 1 to about 15 and is from about 2 to about 10 weight percent of the total molecular weight of the low surface energy polycarbonate, and z is from about 50 to about 400 and comprises a molecular weight of from about 15,000 to about 130,000 of the total molecular weight of the low surface energy polycarbonate.

In specific embodiments, the low surface energy polycarbonate contains from about 4 to about 6 weight percent of PDMS containing block (A) segments. The low surface energy polymer has a molecular weight from about 20,000 to about 200,000. In specific embodiments, it has a molecular weight from about 25,000 to about 130,000 to effect solvent solubility and good coating solution viscosity control for proper imaging layer coating application. Since the presence of PDMS containing block (A) in the polycarbonate backbone do reduce the surface energy of the formulated ACBC, it thereby increases the surface lubricity to impact surface contact friction reduction.

In summary, the FIGURE shows an imaging member having a belt configuration according to the embodiments. In the present embodiments, the ACBC 1 comprises an adhesion promoter 36 and a polymer blend 40 formulated to consist the two film-forming thermoplastic materials. In particular embodiments, the polymer blend 40 is the blending of the film-forming low surface energy polycarbonate and the film-forming anti-static copolymer having polyester, polycarbonate, and polyethylene glycol units in the molecular chain. In embodiments, the adhesion promoter 36 is present in an amount of from about 1 to about 15 weight percent or from about 4 to 8 weight percent based on the total weight of the resulting ACBC layer 1. In other embodiments, the polymer blend 40 is present in an amount of from about 99 to about 85 weight percent or from about 96 to 92 weight percent based on the total weight of the resulting ACBC layer 1. In addition embodiments, PTFE, silica, or metal oxide particles dispersion may also be incorporated into the present embodiments to provide enhanced wear resistance to the ACBC layer of this disclosure.

The present embodiments provide an anti-static, surface lubricating low contact friction, and optically suitable transparency ACBC layer. More importantly, the ACBC formulations of the present embodiments were found to give a surface resistivity of from about $6.0\times10^{12}$ to about $8.0\times10^{12}$ ohm/sq which is lower than the $1\times10^{14}$ ohms/sq for the standard ACBC control. It also has about 85 percent optical transmittance to allow good imaging member belt back erase by radiant light. In addition, the prepared ACBC 1 has excellent adhesion bonding strength to the substrate 10 and is also determined to give anti-curling control effect equivalent to that of the conventional polycarbonate ACBC having same coating layer thickness.

In addition, the electrophotographic imaging members of present embodiments using a belt configuration, the CTL may be re-designed to consist of dual-pass CTL (dual layered CTL) in which they may have the same or different transport molecule to polymer binder ratios. In these embodiments, the electrophotographic imaging members employing a 3 to 5 mils thickness flexible biaxially oriented polyethylene terephthalate (or polyethylene naphthalate) substrate and coated over a single CTL or dual-pass CTL of from about 12 to about 36 micrometers in thickness, the corresponding ACBC thickness of from about 9.0 to about 33.0 micrometers is needed for achieving effective curl control.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Control Example

A flexible electrophotographic imaging member web was prepared by providing a 0.02 micrometer thick titanium layer coated substrate of a biaxially oriented polyethylene naphthalate substrate (PEN, available as KADALEX from DuPont Teijin Films.) having a thickness of 3.5 mils (89 micrometers). The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer had an average dry thickness of 0.04 micrometer as measured with an ellipsometer.

An adhesive interface layer was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

The adhesive interface layer was thereafter coated over with a charge generating layer. The charge generating layer dispersion was prepared by adding 0.45 gram of IUPILON 200, a polycarbonate of poly(4,4'-diphenyl)-1,1'-cyclohexane carbonate (PC-z 200, available from Mitsubishi Gas Chemical Corporation), and 50 milliliters of tetrahydrofuran into a 4 ounce glass bottle. 2.4 grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 mil. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. This charge generating layer comprised of poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometers.

This coated web stock was simultaneously coated over with a charge transport layer (CTL) and a ground strip layer by co-extrusion of the coating materials. The CTL was prepared by introducing into an amber glass bottle in a weight ratio of 1:1 (or 50 weight percent of each) of a bisphenol A polycarbonate thermoplastic (FPC 0170, having a molecular weight of about 120,000 and commercially available from Mitsubishi Chemicals) and a charge transport compound of N,N'-diphenyl-N,N'-bis(3-methylphenyl)-1,1'-biphenyl-4,4'-diamine. The resulting mixture was dissolved to give 15 percent by weight solid in methylene chloride. This solution was applied on the charge generating layer by extrusion to form a coating which upon drying in a forced air oven gave a dry CTL 29 micrometers thick comprising 50:50 weight ratio of diamine transport charge transport compound to FPC 0170 bisphenol A polycarbonate binder.

The strip, about 10 millimeters wide, of the adhesive layer left uncoated by the charge generator layer, was coated with a ground strip layer during the co-extrusion process. The ground strip layer coating mixture was prepared by combining 23.81 grams of polycarbonate resin (FPC 0170, available from Mitsubishi Chemicals) having 7.87 percent by total weight solids and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL, to the electrophotographic imaging member web to form an electrically conductive ground strip layer having a dried thickness of about 19 micrometers.

The imaging member web stock containing all of the above layers was then passed through 125° C. in a forced air oven for 3 minutes to simultaneously dry both the CTL and the ground strip. The imaging member web, at this point if unrestrained, would curl upwardly into a 1½-inch tube.

For imaging member curl control, an anticurl back coating was prepared by combining 88.2 grams of FPC0170 bisphenol A polycarbonate resin, 7.12 grams VITEL PE-200 copolyester adhesion promoter (available from Bostik, Inc., Wauwatosa, Wis.), 9.7 grams of PTFE particles, and 1,071 grams of methylene chloride in a carboy container to form a coating solution containing 8.9 percent solids. The container was covered tightly and placed on a roll mill for about 24 hours until the polycarbonate and polyester were dissolved in the methylene chloride to form the anti-curl back coating solution. The anti-curl back coating solution was then applied to the rear surface (side opposite the charge generating layer and CTL) of the electrophotographic imaging member web by extrusion coating and dried to a maximum temperature of 125° C. in a forced air oven for 3 minutes to produce a dried anticurl back coating (ACBC) having a thickness of 17 micrometers and flattening the imaging member. The flexible imaging member thus obtained was to serve as a control.

Disclosure Example

Three flexible imaging member webs were then prepared by following the exact same procedures and using identical material compositions as those described in the Control Example, but with the exception that the ACBC in each imaging member webs had been replaced by an innovative formulation consisting of a polymer blend of an anti-static polymer and a low surface energy polycarbonate in three weight ratios of 95:5, 90:10, and 75:25 identified respectively as Disclosures I, II, and III.

The anti-static polymer material was a pre-compounded polymer, commercially available from SABIC INNOVATIVE PLASTICS as STAT-LOY 63000CT; to give static-charge dissipation capability. NMR analysis of this compounded polymer showed that it is a mixture of 62 parts of polyester (formed by trans-1,4-cyclohexanedicarboxylic acid and trans/cis mixture of 1,4-cyclohexanedimethanol), 33 parts of Polycarbonate-A and at least 6 parts of polyethylene glycol (PEG). Accordingly, it is by itself consisting of:

| | |
|---|---|
| polyester(trans-1,4-cyclohexanedicarboxylic acid and trans/cis mixture of 1,4-cyclohexanedimethanol) | 62 parts |
| Polycarbonate (PCA) | 33 parts |
| Polyethyleneglycol (PEG) | >6 parts |

Each of the polymer blended ACBCs in the imaging members of this disclosure did also comprise a low surface energy modified polycarbonate which was an A-B diblock copolymer formed by modifying a bisphenol A polycarbonate of poly(4,4'-isopropylidene diphenyl carbonate) to just contain a small fraction of polydimethyl siloxane (PDMS) in the polymer back bone to render ACBC slipperiness. The low surface energy A-B diblock copolymer used was a commercial material available from Sabic Innovative Plastics and had a molecular structure described in Formula (I) below:

Formula (I)

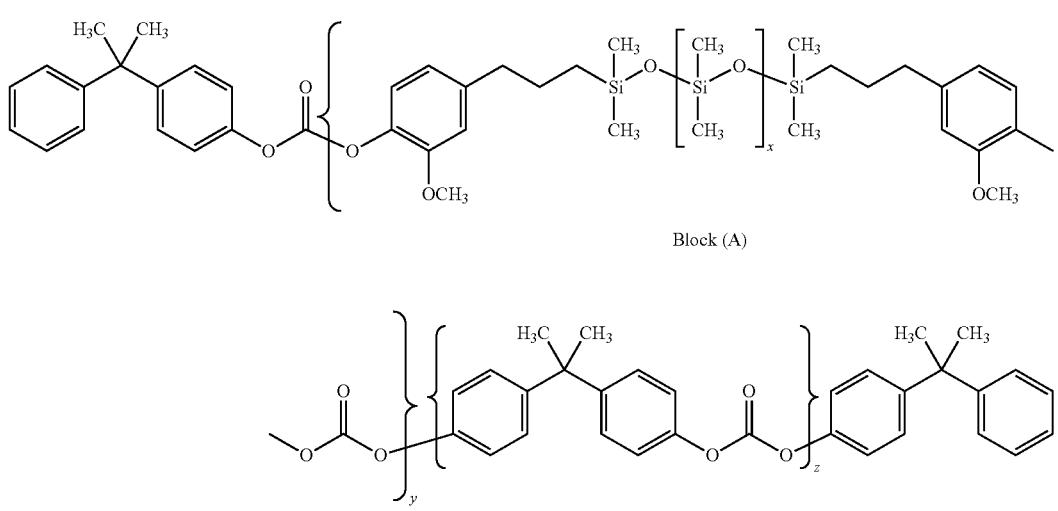

where the repeating units of x is about 50, y is about 9, and z is about 120 for the low surface A-B diblock copolymer having a molecular weight of about 25,000.

The formulated ACBC had a thickness of about 17 micrometers and did also include 8 weight percent of Vitel PE 200 adhesion promoter (obtained from Bostik, Inc. Wauwatosa, Wis.) addition to the ACBC. The prepared flexible imaging member webs thus obtained had flat configuration equivalent to that of the Control imaging member.

Physical/Mechanical and Conductivity Measurement

The surface energy, coefficient of sliding contact friction, and surface adhesiveness of the ACBC comprising low surface energy A-B diblock copolymer incorporation was determined and compared against those of the STD ACBC control. Surface energy was determined by liquid contact angle measurement, sliding contact friction was tested against a stainless steel surface, surface adhesiveness (opposite to adhesion) was conducted by 180° 3M adhesive tape peel test method, while surface resistivity measured at 1000 volts using a HiResta meter. The test results obtained are collectively listed in Table 1 below:

TABLE 1

| ACBC Identification | Surface Energy (dynes/cm) | Coefficient of Friction (against steel) | Tape Peel Strength (gms/cm) | Resistivity (ohms/sq) |
|---|---|---|---|---|
| CONTROL | 40 | 0.41 | 220 | $1 \times 10^{14}$ |
| Disclosure I | 32 | 0.34 | 98 | $6.1 \times 10^{12}$ |
| Disclosure II | 28 | 0.32 | 75 | $7.5 \times 10^{12}$ |
| Disclosure III | 25 | 0.30 | 65 | $7.8 \times 10^{12}$ |

The data in the above table indicate that the prepared slippery ACBC (with low surface energy polymer incorporation)

did provide significant improvements of lowering the surface energy to give adhesiveness as well as contact friction reduction (even without the PTFE dispersion) compared to those of the STD ACBC control. When tested for the sliding action against backer bars, the innovative ACBC were seen to yield up to 1.5 times wear resistance improvement over that of the control ACBC counterpart. Very importantly, all the ACBC formulated and prepared according to the present disclosure were found to have a surface resistivity of almost 2 orders of magnitude lower than that of the STD ACBC control.

Additionally, the invention conductive/slippery ACBC did also have equivalent adhesion bonding strength to the PEN substrate, and also gave about same optical clarity as compared to the control ACBC counterpart.

Imaging Member Belts Machine Cycle Testing

The prepared flexible imaging member web of innovative ACBC formulation comprising polymer blend of anti-static polymer and A-B diblock copolymer in weight ratio of 75:25 along with Control ACBC imaging member web were cut into sheets and converted into imaging member belts by ultrasonic welding process. The belts were dynamically cyclic tested in a Nuevera machine for tribo-electrical charging up assessment. The determination of tribo-electrical potential build-up, with the use of an ESV device, in the ACBC of each P/R belt thus obtained showed that the STD ACBC control belt would quickly build-up trobo-electrical charge of about 180 volts, while that seen for the ACBC of this disclosure was only about 60 volts of tribo-charging up after extended dynamic belt cycling. This result represented about a 67% reduction of tribo-electrical charge demonstrating that surface slipperiness of the ACBC, formulated according to the present disclosure, did provide effective cutting of tribo-electrical charging from the ACBC through its sliding contact friction reduction.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A flexible electrophotographic imaging member comprising:

a flexible substrate;

at least one imaging layer positioned on a first side of the substrate; and an anticurl back coating positioned on a second side of the substrate opposite to the at least one imaging layer, wherein the anticurl back coating comprises a polymer blend of an anti-static polymer and a low surface energy polycarbonate, wherein the anti-static polymer is a thermoplastic copolymer comprising polyester, polycarbonate, and polyethylene glycol, and wherein the low surface energy polycarbonate is an A-B di-block copolymer comprising two segmental blocks, the first segment block (A) being

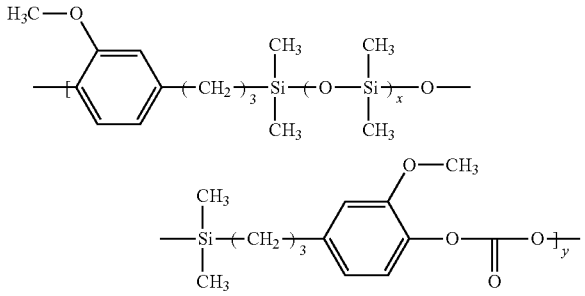

wherein x polydimethyl siloxane (PDMS) repeat units is from about 10 to about 70 and y is from about 1 to about 15, and the second segment block (B) being selected from the group consisting of

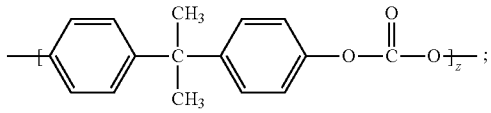

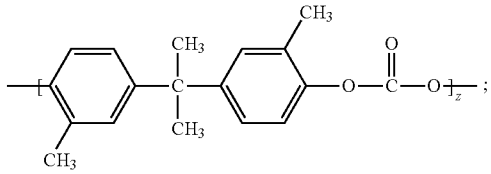

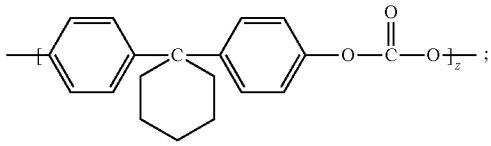

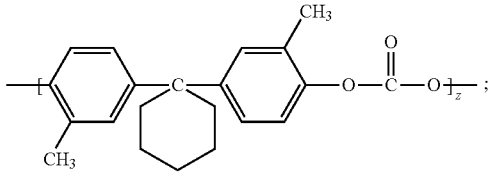

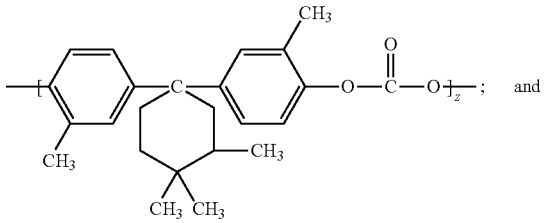

and

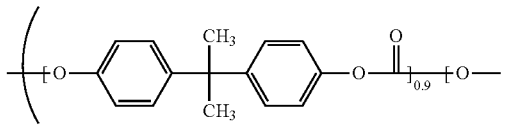

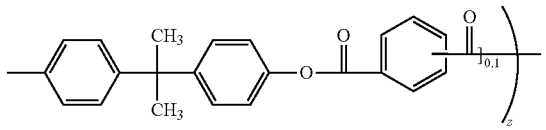

wherein z is from about 50 to about 400.

2. The imaging member of claim 1, wherein the low surface energy A-B diblock copolymer is

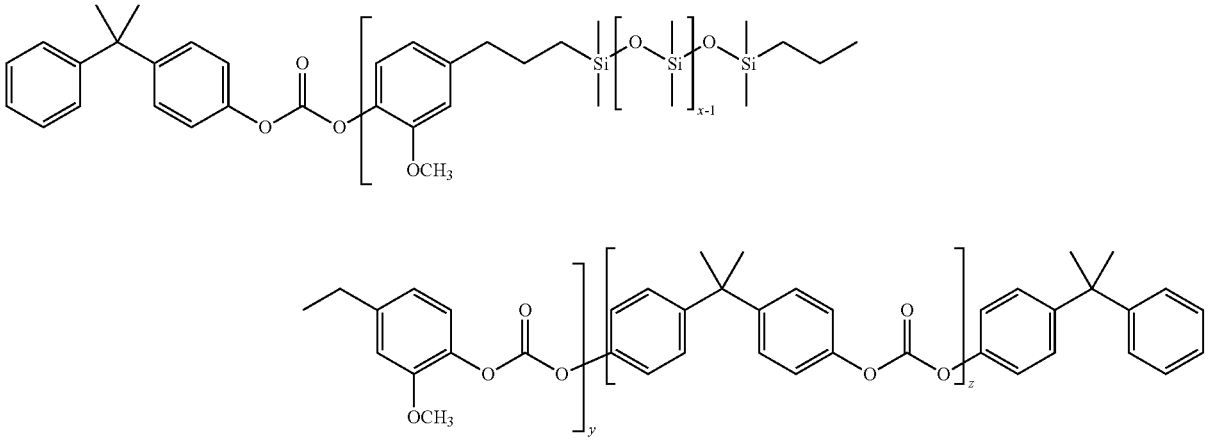

wherein x is from about 11 to about 70, y is from about 1 to about 15 and is from about 2 to about 10 weight percent of the total molecular weight of the low surface energy polycarbonate, and z is from about 50 to about 400 and comprises a molecular weight of from about 15,000 to about 130,000 of the total molecular weight of the low surface energy polycarbonate.

3. The imaging member of claim 2, wherein the low surface energy A-B diblock copolymer comprises from about 4 to about 6 weight percent of polydimethyl siloxane repeat units in block (A) segments based on the total molecular weight of the low surface energy polycarbonate.

4. The imaging member of claim 1, wherein the repeating units x is about 50, y is about 9, and z is about 120 for the low surface energy A-B diblock copolymer having a molecular weight of about 25,000 in the polymer blend.

5. The imaging member of claim 1, wherein a ratio of the anti-static polymer to the low surface energy A-B diblock copolymer is from about 95:5 to about 75:25 by weight based on the total weight of the anticurl back coating layer.

6. The imaging member of claim 5, wherein a ratio of the anti-static polymer to the low surface energy A-B diblock copolymer is from about 95:5 to about 90:10 by weight based on the total weight of the anticurl back coating layer.

7. The imaging member of claim 1, wherein the anticurl back coating layer further comprises a copolyester adhesion promoter present in an amount of from about 1 to about 15 weight percent based on the total weight of the anticurl back coating.

8. The imaging member of claim 1, wherein the anti-static polymer and the low surface energy polycarbonate are both soluble in methylene chloride.

9. The imaging member of claim 1, wherein anticurl back coating further comprises organic fillers or inorganic fillers present in an amount of from about 2 to about 10 weight percent based on the total weight of the anticurl back coating layer.

10. The imaging member of claim 9, wherein the anticurl back coating further comprises organic fillers, and the organic fillers are selected from the group consisting of polytetrafluoroethylene (PTFE), stearates, fluorocarbon (PTFE) polymers, waxy polyethylene, fatty amides, and mixtures thereof.

11. The imaging member of claim 9, wherein the anticurl back coating further comprises inorganic fillers, and the inorganic fillers are selected from the group consisting of silica, metal oxides, metal carbonate, metal silicates, and mixtures thereof.

12. The imaging member of claim 1, wherein the triboelectric charge build-up in the anticurl back coating is reduced from about 180 volts to about 60 volts as compared to an imaging member with an anticurl back coating without the polymer blend.

13. The imaging member of claim 1, wherein the triboelectric charge build-up in the anticurl back coating is reduced by up to about 67 percent as compared to an imaging member with an anticurl back coating without the polymer blend.

14. The imaging member of claim 1, wherein the electrical resistivity of the anticurl back coating is reduced by about two orders of magnitude as compared to an imaging member with an anticurl back coating without the polymer blend.

15. The imaging member of claim 1, wherein the coefficient of friction of the anticurl back coating layer against a sliding action of a metal surface is about 0.3.

16. The imaging member of claim 1, wherein a 180° tape peel-off strength from the surface of the anticurl back coating layer is about 65 grams/cm.

17. The imaging member of claim 1, wherein the anticurl back coating has a surface resistivity of from about $6.0\times10^{12}$ to about $8.0\times10^{12}$ ohm/sq.

18. The imaging member of claim 1, wherein the imaging member further comprising a charge generating layer disposed on a first side of the substrate, and dual charge transport layers disposed on the charge generating layer.

19. A flexible electrophotographic imaging member comprising:

a flexible substrate;

at least one imaging layer positioned on a first side of the substrate; and an anticurl back coating positioned on a second side of the substrate opposite to the at least one imaging layer, wherein the anticurl back coating comprises a polymer blend of an anti-static polymer and a low surface energy polycarbonate, and the low surface energy polycarbonate is an A-B di-block copolymer comprising two segmental blocks, the first segment block (A) being

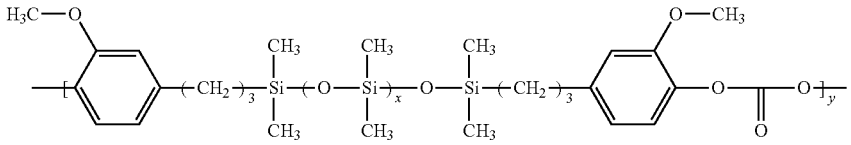

wherein x polydimethyl siloxane (PDMS) repeat units is from about 10 to about 70 and y is from about 1 to about 15, and the second segment block (B) being selected from the group consisting of

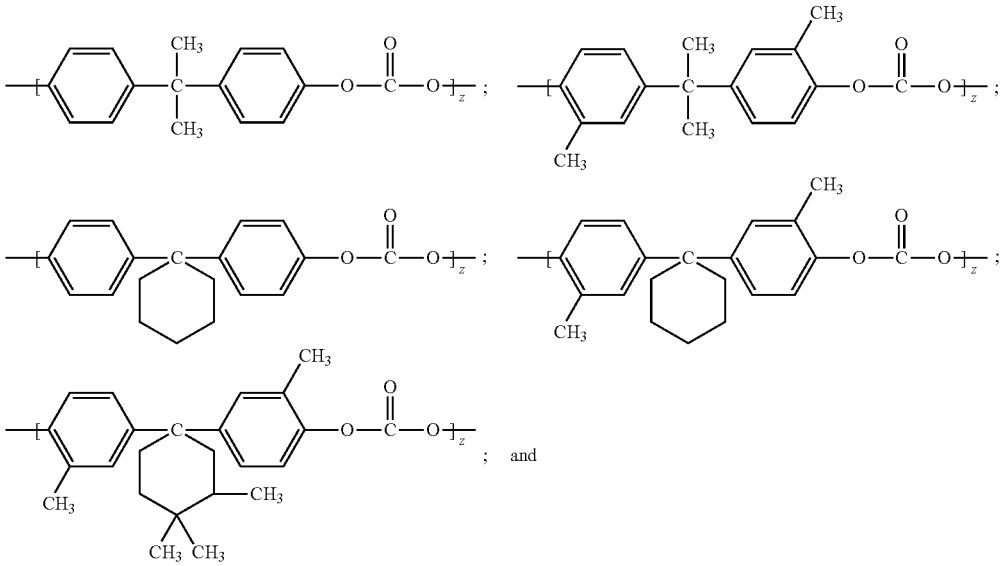

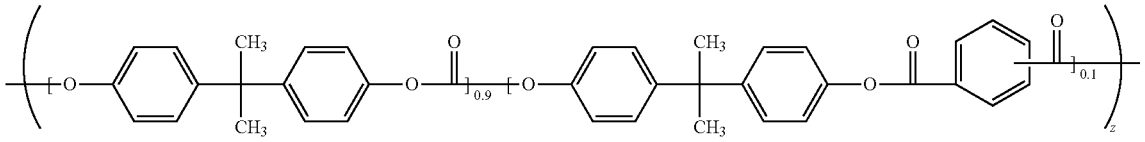

wherein z is from about 50 to about 400, wherein the anti-static polymer is a film-forming thermoplastic copolymer comprising polyester, polycarbonate, and polyethylene glycol units in the molecular chain of the copolymer having a polyester/polycarbonate/polyethylene glycol ratio of about 62/33/6.

20. A flexible imaging member comprising:

a flexible substrate;

a charge generating layer disposed on a first side of the substrate;

a bottom charge transport layer disposed on the charge generating layer;

an outermost top charge transport layer applied over the bottom charge transport layer; and an anticurl back coating positioned on a second side of the substrate opposite to the charge generating and charge transport layers, wherein the anticurl back coating comprises a polymer blend of an anti-static polymer and a low surface energy polycarbonate and a copolyester adhesion promoter, wherein the anti-static polymer is a thermoplastic copolymer comprising polyester, polycarbonate, and polyethylene glycol, and the low surface energy polycarbonate is an A-B di-block copolymer comprising two segmental blocks, the first segment block (A) being

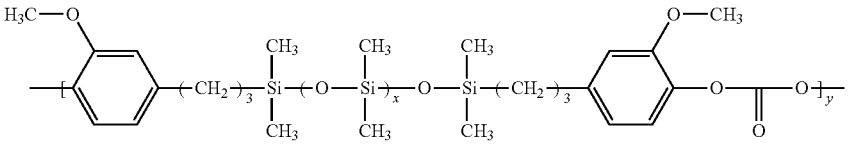

wherein x polydimethyl siloxane (PDMS) repeat units is from about 10 to about 70 and y is from about 1 to about 15, and the second segment block (B) being selected from the group consisting of
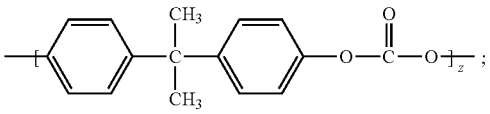
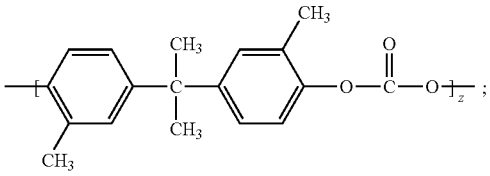
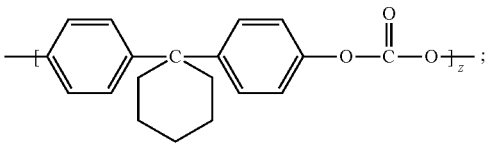
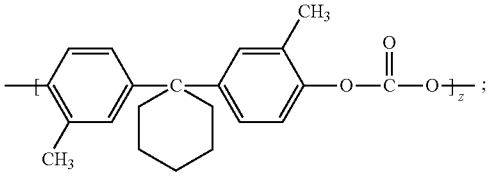
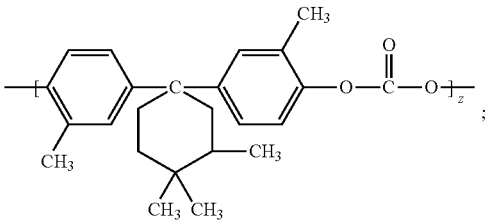
; and
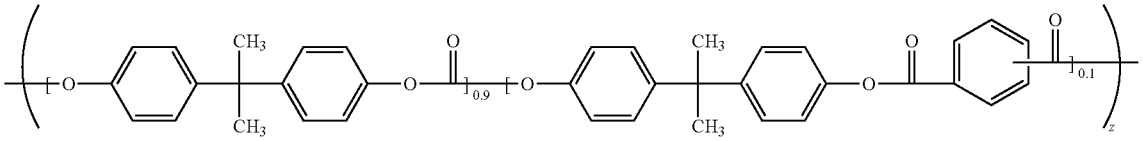
wherein z is from about 50 to about 400.
21. The imaging member of claim 20, wherein the low surface energy A-B diblock copolymer is
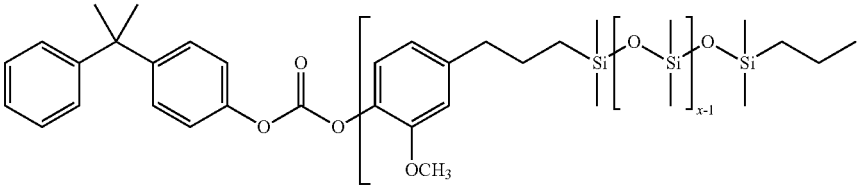
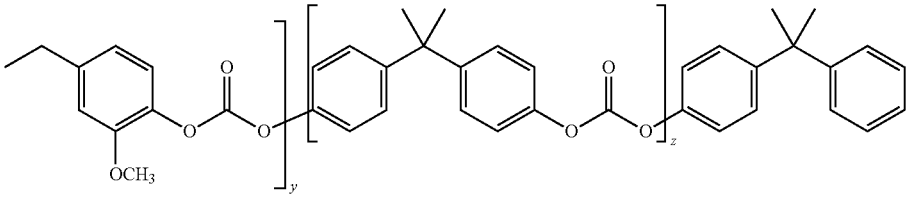

wherein x is from about 11 to about 70, y is from about 1 to about 15, and z is from about 50 to about 400.

22. An image forming apparatus for forming images on a recording medium comprising:

a) a flexible imaging member having a charge retentive-surface for receiving an electrostatic latent image thereon, wherein the flexible imaging member comprises a flexible substrate, at least one imaging layer positioned on a first side of the substrate, and an anticurl back coating positioned on a second side of the substrate opposite to the at least one imaging layer, wherein the anticurl back coating comprising a polymer blend of an anti-static polymer, wherein the anti-static polymer is a thermoplastic copolymer comprises polyester, polycarbonate, and polyethylene glycol, and a low surface energy polycarbonate wherein the low surface energy polycarbonate is an A-B di-block copolymer comprising two segmental blocks, the first segment block (A) being

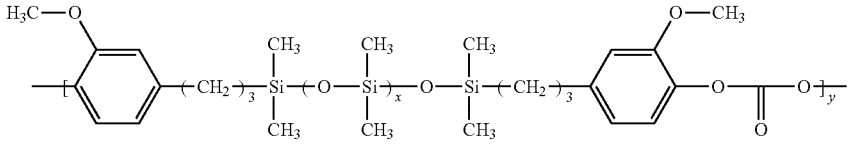

wherein x polydimethyl siloxane (PDMS) repeat units is from about 10 to about 70 and y is from about 1 to about 15, and the second segment block (B) being selected from the group consisting of

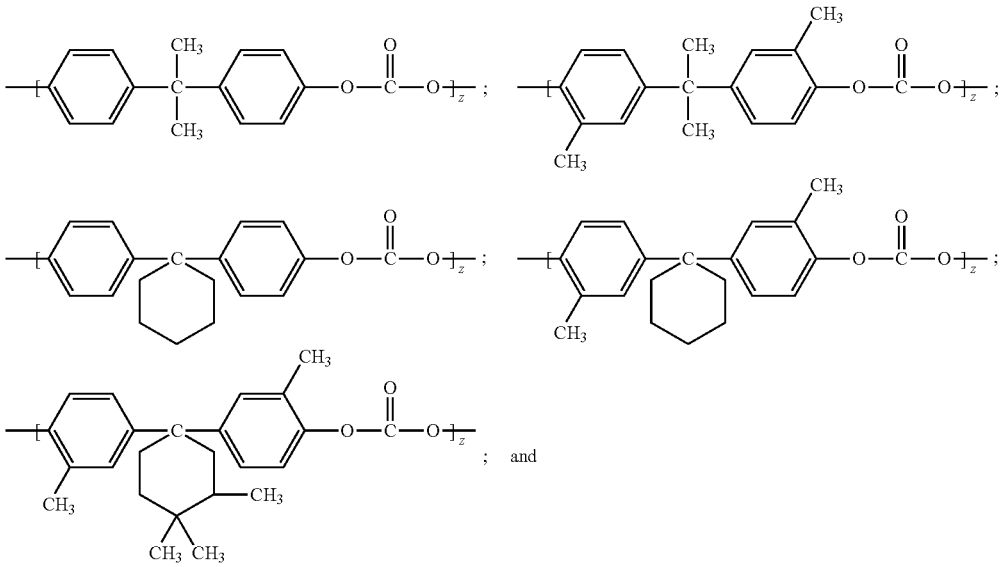

; and

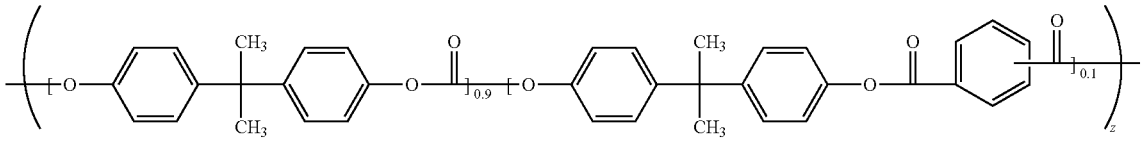

wherein z is from about 50 to about 400;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

23. A flexible imaging member comprising:

a flexible substrate;

a charge generating layer disposed on a first side of the substrate;

a bottom charge transport layer disposed on the charge generating layer;

an outermost top charge transport layer applied over the bottom charge transport layer; and an anticurl back coating positioned on a second side of the substrate opposite to the charge generating and charge transport layers, wherein the anticurl back coating comprises a polymer blend of an anti-static polymer and a low surface energy polycarbonate and a copolyesteradhesion promoter, and the low surface energy polycarbonate is an A-B di-block copolymer comprising two segmental blocks, the first segment block (A) being

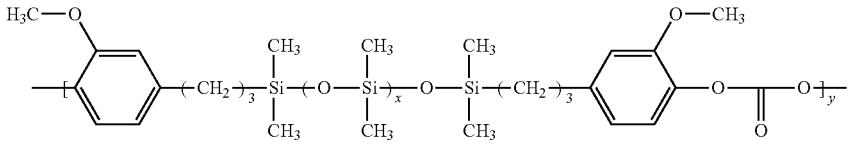

wherein x polydimethyl siloxane (PDMS) repeat units is from about 10 to about 70 and y is from about 1 to about 15, and the second segment block (B) being selected from the group consisting of

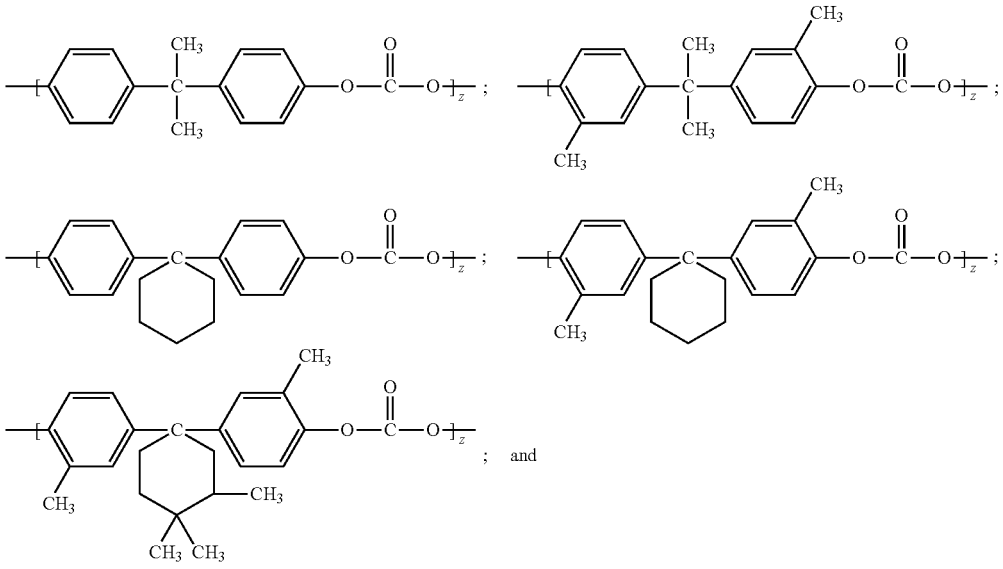

wherein z is from about 50 to about 400, wherein the anti-static polymer is a film-forming thermoplastic copolymer comprising polyester, polycarbonate, and polyethylene glycol units in the molecular chain of the copolymer having a polyester/polycarbonate/polyethylene glycol ratio of about 62/33/6.

24. The imaging member of claim 20, wherein a ratio of the anti-static polymer to the low surface energy polycarbonate is from about 90:10 to about 75:25 by weight based on the total weight of the anticurl back coating layer.

* * * * *